US006539872B2

(12) United States Patent
Pipkin

(10) Patent No.: US 6,539,872 B2
(45) Date of Patent: Apr. 1, 2003

(54) FUZE STERILIZATION USING SACRIFICIAL ANODIC COMPONENT

(75) Inventor: John Pipkin, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 33 days.

(21) Appl. No.: 09/814,485

(22) Filed: Mar. 21, 2001

(65) Prior Publication Data

US 2002/0134272 A1 Sep. 26, 2002

(51) Int. Cl.[7] ..... F42B 22/22

(52) U.S. Cl. ..... 102/408; 102/402; 102/406; 102/416

(58) Field of Search ..... 102/416, 402, 102/406, 408

(56) References Cited

U.S. PATENT DOCUMENTS

| | | | | | |
|---|---|---|---|---|---|
| 913,524 | A | * | 2/1909 | Leon | 102/408 |
| 1,154,272 | A | * | 9/1915 | Senger et al. | 102/408 |
| 1,292,542 | A | * | 1/1919 | Troubtschaninoff | 102/408 |
| 1,379,273 | A | * | 5/1921 | Meden | 102/407 |
| 2,705,919 | A | * | 4/1955 | Semon | 102/408 |
| 3,117,517 | A | * | 1/1964 | Chamberlin et al. | 102/408 |
| 3,221,556 | A | * | 12/1965 | Campbell et al. | 374/136 |
| 3,314,088 | A | * | 4/1967 | Nordhaus et al. | 441/8 |
| 3,559,580 | A | * | 2/1971 | Lyon | 102/408 |
| 3,581,352 | A | * | 6/1971 | Lavin | 403/31 |
| 3,696,747 | A | * | 10/1972 | Kissinger | 102/408 |
| 3,745,922 | A | * | 7/1973 | Lyon | 102/408 |
| 6,050,195 | A | * | 4/2000 | Diorio | 102/257 |

OTHER PUBLICATIONS

Department of Defense Design Criteria Standard Fuze Design, Safety Criteria For (MIL–STD–1316E), Jul. 10, 1998.*

* cited by examiner

*Primary Examiner*—Michael J. Carone
*Assistant Examiner*—Troy Chambers
(74) *Attorney, Agent, or Firm*—Harvey A. Gilbert; Donald G. Peck

(57) ABSTRACT

A method of fuze sterilization is provided for a fuze that includes a first component and a second component with a prescribed relationship being defined therebetween. The prescribed relationship is one that is required for proper detonation operation of the fuze. The first and second components are fabricated from materials having different galvanic potentials. An electrolyte is introduced between the first and second components to initiate galvanic corrosion of one of the components. The galvanic corrosion continues for a period of time until the prescribed relationship between the first and second components changes sufficiently to disable the detonation operation of the fuze.

21 Claims, 2 Drawing Sheets

FUZE STERILIZATION USING SACRIFICIAL ANODIC COMPONENT

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the sterilization of a fuze, and more particularly to a method and system for implementing fuze sterilization using a sacrificial anodic component.

BACKGROUND OF THE INVENTION

When a munition is deployed, a fuze is used to detonate the munition reliably. However, since fuzes are not reliable 100% of the time, it is possible to have a number of undetonated munitions littering a battle zone. Such undetonated munitions pose a safety hazard to both advancing friendly forces and to.civilians who later reside in or pass through the area. Accordingly, the North American Treaty Organization (NATO) and the U.S. Department of Defense (DoD) have regulations specifying safety criteria for all munition fuzes. For example, the DoD uses Military Standard 1316 which requires all fuzes to provide a sterilization feature, the primary function of which is to disable the fuze so that it can no longer detonate the munition after a specified amount of time. Timing and reliability requirements for fuze sterilization are determined by system safety issues and mission requirements.

Undetonated underwater munitions (e.g., underwater mines) are of great concern for several reasons. Since underwater munitions are designed to be deployed in the water, they are inherently invisible to friendly and/or civilian ship traffic. Further, underwater munitions are frequently scattered in an area of anticipated enemy activity and are designed to detonate when such activity is detected. However, if some of the underwater munitions are not in a position to be detonated by the enemy activity, they remain as a safety hazard in the presence of subsequent activity by friendly forces or civilians. Still further, the harsh seawater environment could disable the underwater fuze sterilization system thereby allowing the munition to remain live for long periods of time.

SUMMARY OF THE INVENTION

Accordingly, it is an object of the present invention to provide a method of fuze sterilization for a munition.

Another object of the present invention is to provide a method of fuze sterilization that is reliable in harsh underwater environments.

Other objects and advantages of the present invention will become more obvious hereinafter in the specification and drawings.

In accordance with the present invention, a method of fuze sterilization is provided for a fuze that includes a first component and a second component with a prescribed relationship being defined therebetween. The prescribed relationship is one that is required for proper detonation operation of the fuze. The first component is fabricated from a first material and the second component is fabricated from a second material where the first and second materials have different galvanic potentials, i.e., one of the materials is anodic relative to the other material in the presence of an electrolyte. An electrolyte is introduced between the first and second components. As a result, one of the first and second components undergoes galvanic corrosion. The galvanic corrosion continues for a period of time until the prescribed relationship between the first and second components changes sufficiently to disable the detonation operation of the fuze.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
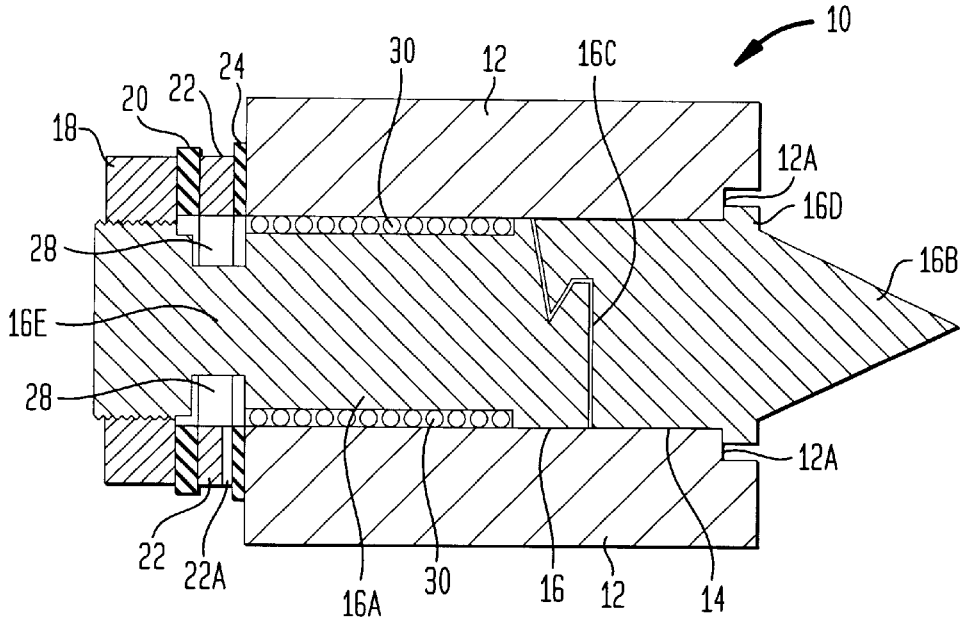
FIG. 1 is a side cross-sectional view of a firing pin assembly constructed to fail after a period of time in accordance with the present invention.

In the present invention, the goal is to bring about failure of a munition's fuze device. By way of illustrative example, the present invention will be described for use with fuzes that will be deployed in underwater (i.e., seawater) environments. However, it is to be understood that the method of the present invention could also be adapted for use with fuzes that are not deployed in water.

A common unintended failure experienced by equipment used in seawater (i.e., salt water) is failure by galvanic corrosion of a critical component. Seawater, because of its mineral content, is an electrolyte. When two materials with sufficiently different galvanic potentials are placed in contact with an electrolyte, one will act as the anode and the other as the cathode. In this environment, the anode will give up electrons (i.e., oxidation) and the cathode will accept electrons (i.e., reduction). This process is destructive to the anode.

It is the intent of the present invention to sterilize a fuze using galvanic corrosion of a critical component. By making a critical component(s) in a fuze the anode and adjacent or surrounding component(s) cathodes, and subsequently introducing an electrolyte therebetween, a galvanic couple is formed that will corrode away the critical (anode) component(s). The present invention can be used for both in-water and out-of-water applications. The in-water applications can use the water environment as the electrolyte. The out-of-water environments can store the electrolyte inside the fuze and introduce it between the anodic and cathodic components when required.

The present invention is achieved by intentionally making a critical component of the fuze the anode in a galvanic couple. Any critical component that is exposed to seawater, or some other electrolyte, after deployment can be used as the anode. The electrolyte can be obtained from the environment or stored/released by the fuze. The rate of oxidation at the anode could also be increased by choosing an electrolyte with a lower electrical resistance than that of seawater. However, if the electrolyte is not readily available from the surrounding environment, the electrolyte must be stored with the fuze. Another alternative is to mix dry chemicals with seawater in order to increase the electrical conductivity thereof. For example, sodium chloride could be mixed with seawater.

The time it takes to cause a failure of the critical anodic component will primarily depend on the size of the anode relative to the cathode and the potential difference between the anode and cathode. To increase the rate of oxidation of the anode, the anode is chosen to be as small as possible and the cathode is chosen to be as large as possible while maintaining other fuze design constraints. The anode could also be reduced in size by coating or painting it everywhere except where the failure is intended. The effect of the cathode can be increased by coating a surrounding material with a material that is less active. To prevent polarization of the cathode, the cathode should be placed such that water (or other electrolyte) flow over the surface of the cathode is maximized.

The present invention can be implemented in a variety of ways, three of which will be described herein. Referring now to the drawings, and more particularly to FIG. 1, the firing pin assembly of a fuze equipped for fuze sterilization in accordance with the present invention is shown and is referenced generally by numeral 10. Firing pin assembly 10 is typical of what might be used with a stab detonator. Specifically, a housing 12 has a sleeve 14 formed therein for slidingly receiving a two-part firing pin 16. Firing pin 16 has a shaft 16A coupled to pin 16B at, for example, a z-clasp 16C that resides in sleeve 14 as long as assembly 10 is enabled for operation. That is, for detonation to occur, a detonator (not shown) would be forced into engagement with pin 16B. Accordingly, pin 16B must be present and protrude from housing 12 as shown for firing pin assembly 10 to be enabled. To retain firing pin 16 in the enabled configuration, i.e., in its prescribed relationship with housing 12, an annular flange 16D on pin 16B engages an annular seat 12A in housing 12 while shaft 16A protruding from the opposite end of housing 12 is engaged by a threaded nut 18.

Disposed between nut 18 and housing 12 are a series of washers 20, 22 and 24. Washers 20 and 24 are made from a dielectric material while washer 22 is made from a material that will serve as a cathode as compared to the necked-down portion 16E of shaft 16A that it surrounds. That is, shaft 16A (or at least portion 16E) is made from a material that is anodic relative to washer 22 when shaft 16A and washer 22 are contacted with an electrolytic material. A gap or air space 28 is defined between washer 22 and shaft 16A. Washer 22 is provided with slots 22A (or ports) to provide for the introduction of an electrolyte into gap 28. Note that portion 16E of shaft 16A surrounded by washer 22 can be sized to control the amount of time it takes for corrosion failure to occur as will now be explained.

Figure 2:
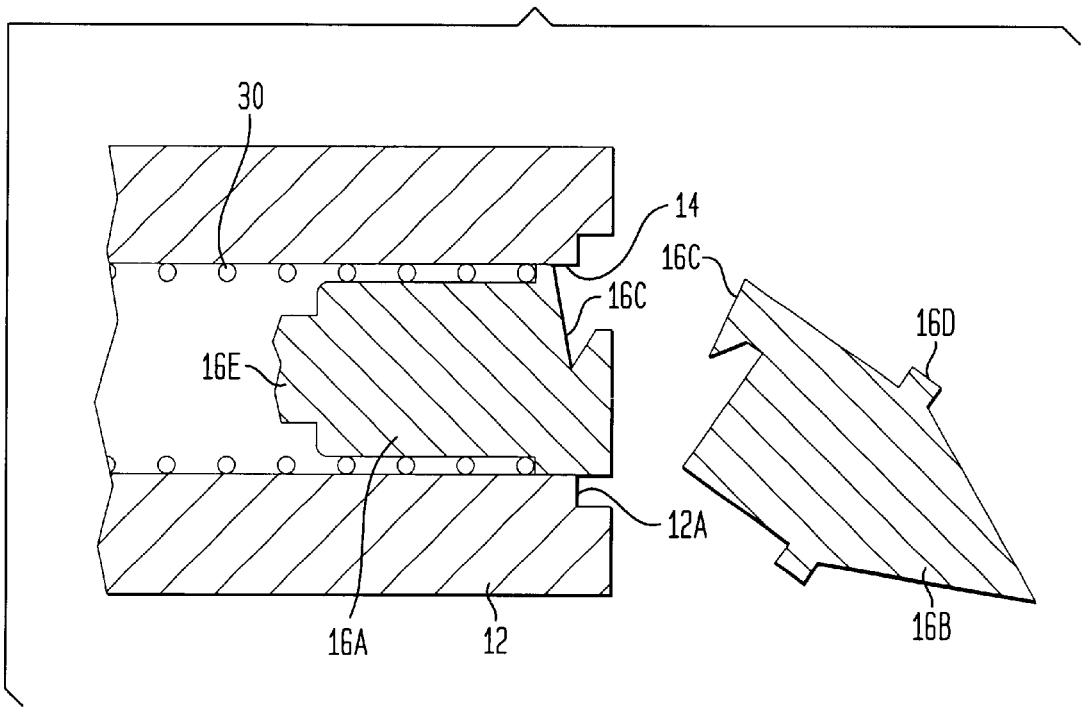
FIG. 2 is a side view of the firing pin after it has been disabled in accordance with the present invention.

It is assumed herein that firing pin assembly 10 will be immersed in a seawater environment during its use such that the area about washer 22 is immersed in seawater. Once this occurs, seawater (not shown) will flow through slots 22A into gap 28 and initiate galvanic corrosion of portion 16E of shaft 16A. Corrosion will continue until failure occurs at portion 16E whereby a compressed spring 30 (engaging shaft 16A in sleeve 14) can act on firing pin 16. As shown in FIG. 2, the release of spring 30 causes z-clasp 16C to exit the radial constraint of sleeve 14 thereby allowing pin 16B to fall off. Note that spring 30 is sized to maintain the remaining portion of shaft 16A in sleeve 14. Thus, the fuze incorporating assembly 10 is disabled since there is no longer any pin to engage an impinging detonator.

Figure 3:
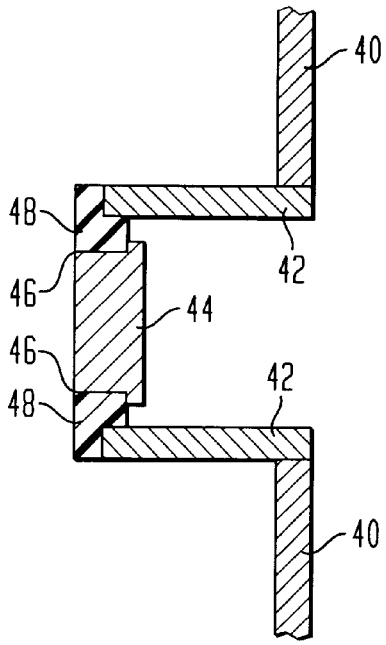
FIG. 3 is a side view of a portion of a sealed fuze cavity equipped with a seal constructed to fail after a period of time in accordance with the present invention.

Another type of fuze that could utilize the fuze sterilization of the present invention is one having a sealed cavity that must remain dry at all times for proper operation. That is, the critical anodic component could be the cavity's seal while the cathodic component could surround the seal. For example, as shown in FIG. 3, a fuze cavity 40 could be sealed in the following manner. A cathodic sleeve 42 could support therein an anodic sealing disk 44 that is sealingly supported in a cavity hole 46 by a dielectric gasket assembly 48. This fixed prescribed relationship between sleeve 42 and disk 44 will be maintained as long as no electrolyte is present therebetween. However, when immersed in an electrolyte such as seawater, disk 44 and sleeve 42 are coupled via the seawater and disk 44 corrodes until it fails whereby seawater enters cavity 40 to disable the fuze.

Figure 4:
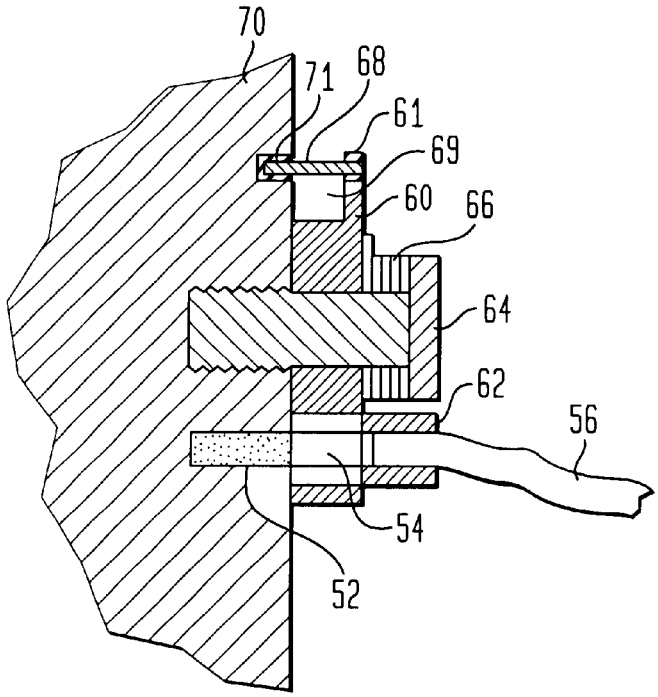
FIG. 4 is a side view of a fuze design having an assembly that disrupts the fuze's detonation train after a period of time in accordance with the present invention.

In yet another type of fuze design illustrated in FIG. 4, a detonation train is required for proper fuze operation. The detonation train can include a detonation cord 50 coupled to a fuze output charge 52 by means of a booster charge 54. One way to disable or sterilize the detonation train is to move detonation cord 50 and booster charge 54 out of alignment with fuze output charge 52. For example, detonation cord 50 could terminate in a cord holder 62 of a pivot plate 60 while booster charge 54 is maintained in pivot plate 60 as shown. Pivot plate 60 is attached to, for example, a munition body 70 by means of a screw 64. A torsion spring 66 is coupled between pivot plate 60 and screw 64 such that pivot plate 60 is biased to rotate about screw 64. Such rotation is designed to disrupt the alignment of booster charge 54 and fuze output charge 52.

To prevent such rotation when the detonation train is in alignment, a retaining pin 68 is captured in pivot plate 60 and munition body 70. In accordance with the present invention, pin 68 is anodic relative to pivot plate 60 and/or munition body 70. Thus, a gap or air space 69 must be provided between pin 68 and pivot plate 60 and/or munitions body 70. Further, pin 68 should be electrically isolated from pivot plate 60 and/or munition body 70 and is, therefore retained in dielectric sleeves 61 and 71, respectively. The prescribed relationship between the cathodic pivot plate 60 (and/or munitions body 70) and the anodic pin 68 will be maintained as long as no electrolyte is present therebetween. However, when an electrolyte is introduced into gap 69, pin 68 undergoes galvanic corrosion until it fails whereby pivot plate 60 rotates under the force of torsion spring 66 to disrupt alignment of the above-described detonation train to disable the fuze.

The advantages of the present invention are numerous. A reliable failure mechanism is now available for harsh seawater environments that takes advantage of the seawater's electrolytic properties. The method can be applied to a variety of underwater fuze designs without requiring any provision for an electrolyte. However, the method can also be adopted for dry-land fuze sterilization as long as provision is made for the timely introduction of an electrolyte between the critical anodic and cathodic components.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of fuze sterilization comprising the steps of:

providing a fuze that includes a first component and a second component defining a prescribed relationship therebetween that is required for detonation operation of said fuze;

fabricating said first component from a first material and said second component from a second material, said first material and said second material being of different galvanic potentials; and introducing an electrolyte between said first component and said second component wherein one of said first component and said second component undergoes galvanic corrosion for a period of time until said prescribed relationship changes sufficiently to disable said detonation operation of said fuze.

2. A method according to claim 1 further comprising the step of applying a coating to selected portions of one of said first component and said second component, said coating inhibiting said galvanic corrosion at said selected portions.

3. A method according to claim 1 wherein said electrolyte is seawater.

4. A method according to claim 1 wherein said electrolyte is a seawater-based.

5. A method according to claim 1 wherein said electrolyte is seawater mixed with sodium chloride.

6. A method according to claim 1 wherein said fuze is an underwater fuze, and wherein said step of introducing comprises the step of placing said fuze in water.

7. A method according to claim 1 further comprising the step of sizing each of said first component and said second component to control said period of time.

8. A method of fuze sterilization comprising the steps of:

providing a fuze that includes a first component and a second component defining a prescribed relationship therebetween that is required for detonation operation of said fuze;.

defining an air space between at least a portion of said first component and a portion of said second component;

fabricating said first component from a first material and said second component from a second material;

selecting said first material to be anodic relative to said second material; and introducing an electrolyte into said air space wherein said portion of said first component undergoes galvanic corrosion for a period of time until said prescribed relationship changes sufficiently to disable said detonation operation of said fuze.

9. A method according to claim 8 further comprising the step of applying a coating to selected areas of said portion of said first component, said coating inhibiting said galvanic corrosion at said selected areas.

10. A method according to claim 8 wherein said electrolyte is seawater.

11. A method according to claim 8 wherein said electrolyte is a seawater-based.

12. A method according to claim 8 wherein said electrolyte is seawater mixed with sodium chloride.

13. A method according to claim 8 wherein said fuze is an underwater fuze, and wherein said step of introducing comprises the step of placing said fuze in water.

14. A method according to claim 8 further comprising the step of sizing said portion of said first component to control said period of time.

15. A method of fuze sterilization comprising the steps of:

providing a fuze that includes a first component and a second component defining a prescribed relationship therebetween that is required for detonation operation of said fuze wherein, in said prescribed relationship, a gap is defined between said first component and said second component;

fabricating said first component from a first material and said second component from a second material;

selecting said first material to be anodic relative to said second material when said first material and said second material are contacted by an electrolytic material; and filling said gap with an electrolyte wherein at least a portion of said first component undergoes galvanic corrosion for a period of time until said prescribed relationship changes sufficiently to disable said detonation operation of said fuze.

16. A method according to claim 15 further comprising the step of applying a coating to selected areas of said portion of said first component, said coating inhibiting said galvanic corrosion at said selected areas.

17. A method according to claim 15 wherein said electrolyte is seawater.

18. A method according to claim 15 wherein said electrolyte is a seawater-based.

19. A method according to claim 15 wherein said electrolyte is seawater mixed with sodium chloride.

20. A method according to claim 15 wherein said fuze is an underwater fuze, and wherein said step of filling includes the step of placing said fuze in seawater.

21. A method according to claim 15 further comprising the step of sizing said first component to control said period of time.

* * * * *